US011808060B2

(12) United States Patent
Schroll

(10) Patent No.: US 11,808,060 B2
(45) Date of Patent: Nov. 7, 2023

(54) LOCK WITH SLIDING LOCK BODY PORTIONS

(71) Applicant: The Eastern Company, Naugatuck, CT (US)

(72) Inventor: Matthew Schroll, Glendale Heights, IL (US)

(73) Assignee: The Eastern Company, Naugatuck, CT (US)

( * ) Notice: Subject to any disclaimer, the term of this patent is extended or adjusted under 35 U.S.C. 154(b) by 389 days.

(21) Appl. No.: 17/083,562

(22) Filed: Oct. 29, 2020

(65) Prior Publication Data

US 2021/0131148 A1 May 6, 2021

Related U.S. Application Data

(60) Provisional application No. 62/929,242, filed on Nov. 1, 2019.

(51) Int. Cl.

| | |
|---|---|
| ***E05B 67/00*** | (2006.01) |
| ***E05B 73/00*** | (2006.01) |
| ***E05B 71/00*** | (2006.01) |

(52) U.S. Cl.

CPC ..... *E05B 67/003* (2013.01); *E05B 71/00* (2013.01); *E05B 73/0005* (2013.01)

(58) Field of Classification Search

CPC ..... E05B 67/003; E05B 67/06; E05B 71/00; E05B 73/00; E05B 73/0005; E05B 73/0041

See application file for complete search history.

(56) References Cited

U.S. PATENT DOCUMENTS

| | | | |
|---|---|---|---|
| 1,545,902 | A | 7/1925 | Johnson |
| 1,681,409 | A | 8/1927 | Johnson |

(Continued)

FOREIGN PATENT DOCUMENTS

| | | | |
|---|---|---|---|
| CN | 1473232 | A | 2/2004 |
| DE | 202005009751 | U1 | 9/2005 |
| GB | 2293196 | A | 3/1996 |

OTHER PUBLICATIONS

US Patent and Trademark Office, Office Action in U.S. Appl. No. 17/083,585, dated Oct. 31, 2022.

(Continued)

*Primary Examiner* — Christopher J Boswell
(74) *Attorney, Agent, or Firm* — Leydig, Voit & Mayer, Ltd.

(57) ABSTRACT

In one embodiment, the invention provides a lock body comprising a base portion and a moveable portion with each having first and second sides. One of the base portion second side and the moveable portion first side has an extension and the other having a receiver to allow the moveable portion to move translationally with respect to the base portion. A slot is transverse to the extension and cut into one of the face of the second side of the base portion or the first side of the moveable portion. In the open state the portions are separated and in the locked state the faces are substantially adjacent to capture a cylindrical object in the slot. In another embodiment, the lock body is cylindrical with a pair of transverse apertures. A plug inside the lock body moves translationally to capture an object between the apertures.

7 Claims, 15 Drawing Sheets

(56) References Cited

U.S. PATENT DOCUMENTS

| | | | | |
|---|---|---|---|---|
| 2,623,378 | A | 12/1952 | Haver | |
| 3,738,132 | A | 6/1973 | Nagel | |
| 3,765,196 | A | 10/1973 | Balicki | |
| 3,933,015 | A * | 1/1976 | Balicki | E05B 67/003 70/49 |
| 4,325,238 | A * | 4/1982 | Scherbing | E05B 67/003 70/49 |
| 5,517,835 | A * | 5/1996 | Smith | E05B 73/0005 D8/333 |
| 5,937,678 | A * | 8/1999 | Kuo | E05B 67/003 70/49 |
| 6,006,555 | A | 12/1999 | Shu-Fen | |
| 6,131,969 | A | 10/2000 | Natkins | |
| 6,212,919 | B1 | 4/2001 | Gerow | |
| 6,263,711 | B1 | 7/2001 | Kuo | |
| D457,802 | S | 5/2002 | Meekma et al. | |
| 6,412,315 | B1 | 7/2002 | Cheng et al. | |
| 6,470,718 | B1 | 10/2002 | Yang | |
| D469,332 | S | 1/2003 | Meekma et al. | |
| 6,622,532 | B2 * | 9/2003 | Hsu | E05B 73/0082 248/316.4 |
| 6,629,440 | B1 | 10/2003 | Meekma et al. | |
| 6,775,054 | B1 | 8/2004 | Smith et al. | |
| 6,923,027 | B1 * | 8/2005 | Kuo | E05B 67/003 70/49 |
| 7,104,093 | B2 | 9/2006 | Ling et al. | |
| 7,293,438 | B2 | 11/2007 | Benda | |
| 7,513,133 | B2 * | 4/2009 | Muerza | E05B 73/0005 70/30 |
| 7,661,280 | B1 | 2/2010 | Weyland | |
| 7,784,313 | B2 * | 8/2010 | Wyers | E05B 67/003 70/49 |
| 7,870,764 | B2 | 1/2011 | Burmesch | |
| 8,056,377 | B2 | 11/2011 | Hacker | |
| 8,297,086 | B2 | 10/2012 | Yu et al. | |
| 8,578,743 | B2 | 11/2013 | Yu | |
| 8,607,600 | B2 | 12/2013 | Burmesch et al. | |
| D702,102 | S | 4/2014 | Stevens | |
| 10,352,068 | B2 | 7/2019 | Hollis | |
| 10,435,919 | B2 * | 10/2019 | Pelaez | E05B 67/36 |
| 10,668,866 | B2 | 6/2020 | Kuschmeader et al. | |
| 11,053,712 | B2 * | 7/2021 | Lin | E05B 67/003 |
| 2003/0196462 | A1 | 10/2003 | Chen | |
| 2005/0092037 | A1 | 5/2005 | Meekma et al. | |
| 2005/0262904 | A1 * | 12/2005 | Ling | E05B 67/003 70/49 |
| 2009/0025433 | A1 | 1/2009 | Evans | |
| 2016/0194905 | A1 | 7/2016 | Edell | |
| 2019/0383058 | A1 | 12/2019 | Misner | |
| 2021/0131148 | A1 | 5/2021 | Schroll | |

OTHER PUBLICATIONS

Bosvision, "Bosvision 4-digit combination padlock with cable of 2 end loops (loop cable lock) for bike, ski, camping, garden, warehouse and factory," product page downloaded from the Internet at https://amzn.to/2P7EQ61 on Oct. 20, 2020, 9 pp.

Performance Bicycle, "Abus Multiloop Cable Review," YouTube video downloaded from the Internet at https://bit.ly/2ZhH5Do on Oct. 20, 2020, 7 pp. (Jun. 2, 2015).

Lifeventure, "Sliding Cable Lock," YouTube video downloaded from the Internet at https://bit.ly/2NhRPQ1 on Oct. 20, 2020, 6 pp. (Nov. 16, 2013).

Seattle Sports, "Cradle Lock Instructions," product instructions downloaded from the Internet at https://www.seattlesportsco.com/pub/media/productattach/0/5/058424_cradle_lock_instructions_2011.pdf on Oct. 20, 2020, 1 p. (2011).

* cited by examiner

LOCK WITH SLIDING LOCK BODY PORTIONS

CROSS-REFERENCE TO RELATED APPLICATIONS

This application claims the benefit of, and priority to, U.S. Provisional Patent Application No. 62/929,242 (filed Nov. 1, 2019), which is incorporated by reference herein in its entirety.

BACKGROUND OF THE INVENTION

The present invention is directed toward a lock useful in capturing cylindrically shaped objects such as cables or hitch pins and securing objects with those cables and hitch pins.

BRIEF SUMMARY OF THE INVENTION

In one embodiment, the invention provides a lock body comprising a base portion and a moveable portion with each having first and second sides and one of the base portion first side and the moveable portion second side having a keyway adapted to accept a key to change the state of the lock. One of the base portion second side and the moveable portion first side has an extension and the other has a receiver to allow the moveable portion to move translationally with respect to the base portion. Each of the base portion second side and the moveable portion first side has a face. A slot transverse to the extension is cut into one of the face of the second side of the base portion or the first side of the moveable portion. In the open state the faces are separated and in the locked state the faces are substantially adjacent.

In one embodiment, a cable extends from the first side of the base portion with the cable having a diameter less than the diameter of the slot. The cable also has a stop at the other end, with the stop having a diameter greater than the diameter of the slot.

The invention also provides a cable lock for encircling and restraining a first object to a second object. The cable has a first diameter and a stop at a first end with a second larger diameter. The second end of the cable is attached to a first side of a base portion of a lock body. The base portion has a second side with a face and an extension protruding therefrom. The lock body also has a moveable portion with a first side having a receiver that slides along the extension to allow the moveable portion to move translationally along the extension. A slot is cut into one of or both the face of the second side of the base portion or the first side of the moveable portion, with the diameter of the slot being greater than the diameter of the cable but less than the diameter of the stop.

In one embodiment, the stop comprises a loop of the cable and a splice that creates the loop.

The invention also provides a trailer hitch lock for capturing a hitch pin. The hitch pin has a cylindrical portion with a first diameter and a bent or enlarged portion at a distal end and a notched portion of a reduced second diameter near a proximal end. The lock has a lock body with a base portion and a moveable portion, with each portion having a first and second side and one of the base portion or the moveable portion having an extension and the other a receiver adapted to allow the moveable portion to move translationally with respect to the base portion from a closed locked state to an open unlocked state. A slot is cut into one or both the second face of the base portion or the first face of the moveable portion, with the slot having a diameter smaller than the pin first diameter and larger than the notch second diameter. In an open unlocked state, the cylindrical portion of the pin can pass through the slot and in the locked state the notch is captured in the slot.

In another embodiment, the invention provides a lock for capturing a cylindrical object comprising a hollow cylindrical lock body having a first portion with a first interior diameter and a second portion with a second interior diameter with the first interior diameter larger than the second interior diameter and a shoulder separating the two interior diameters, the lock body first portion also having a pair of opposed transverse apertures having a first diameter. A fixed cap has a first end enclosing the end of the first portion of the lock body and a second end proximate the apertures. A barrel is configured to have limited longitudinal movement in the lock body, with the barrel having interior splines configured to accept tumblers and a first face opposite the cap second end. A spring is adapted to bias the barrel away from the cap. A plug has a keyway and radially extending tumblers, with the plug configured to rotate inside the barrel when the tumblers are retracted from the splines by an appropriate key inserted into the keyway. The plug also has a cam that provides motion normal to the longitudinal axis of the lock body when the plug is rotated. A bolt in the interior of the lock body is biased to move radially outwardly to contact the shoulder in a first locked state wherein the cap second end and the barrel first face are located at a distance less than the first diameter of the apertures, and is also configured to be moved by the cam against the bias to retract the bolt away from the shoulder in an unlocked state and the spring biases the barrel first face away from the cap second end to a distance equal to or larger than the apertures first diameter.

In one embodiment the lock also has an aperture in the cap, with the cap aperture having an axis normal to the axis of the lock body and the cap aperture having a smaller diameter than the lock body apertures. The lock also has an elongate cable extending through the cap aperture, the cable having a fixed loop having and exterior diameter and an interior diameter at a first end and a knob having a diameter at a second end, with the loop exterior diameter and the knob diameter being larger than the diameter of the cap aperture.

Further and alternative aspects and features of the disclosed principles will be appreciated from the following detailed description and the accompanying drawings. As will be appreciated, the principles disclosed herein are capable of being carried out in other and different embodiments, and capable of being modified in various respects. Accordingly, it is to be understood that both the foregoing general description and the following detailed description are exemplary and explanatory only and do not restrict the scope of the appended claims.

DESCRIPTION OF A PREFERRED EMBODIMENT

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice versa without limiting the scope of the disclosure to the exact number or type of such elements unless set forth explicitly in the appended claims. The terms adapted, configured and configuration may be used herein to refer to a specified arrangement, or a structural size and shape.

Figure 1:
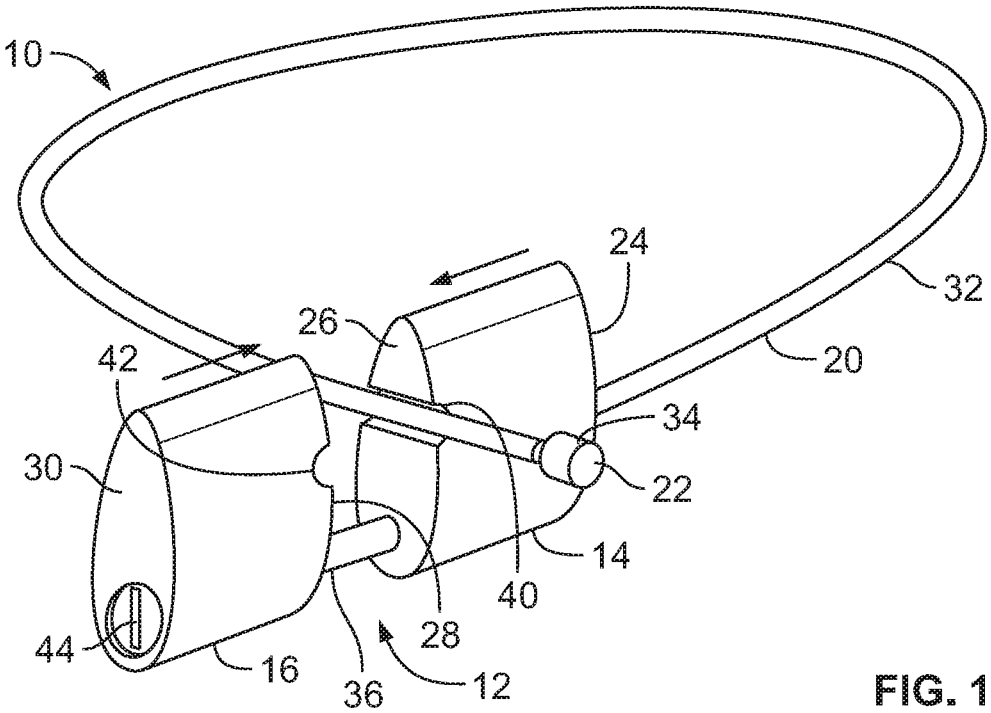
FIG. 1 is a perspective view of an embodiment of the invention in an unlocked state.
Figure 2:
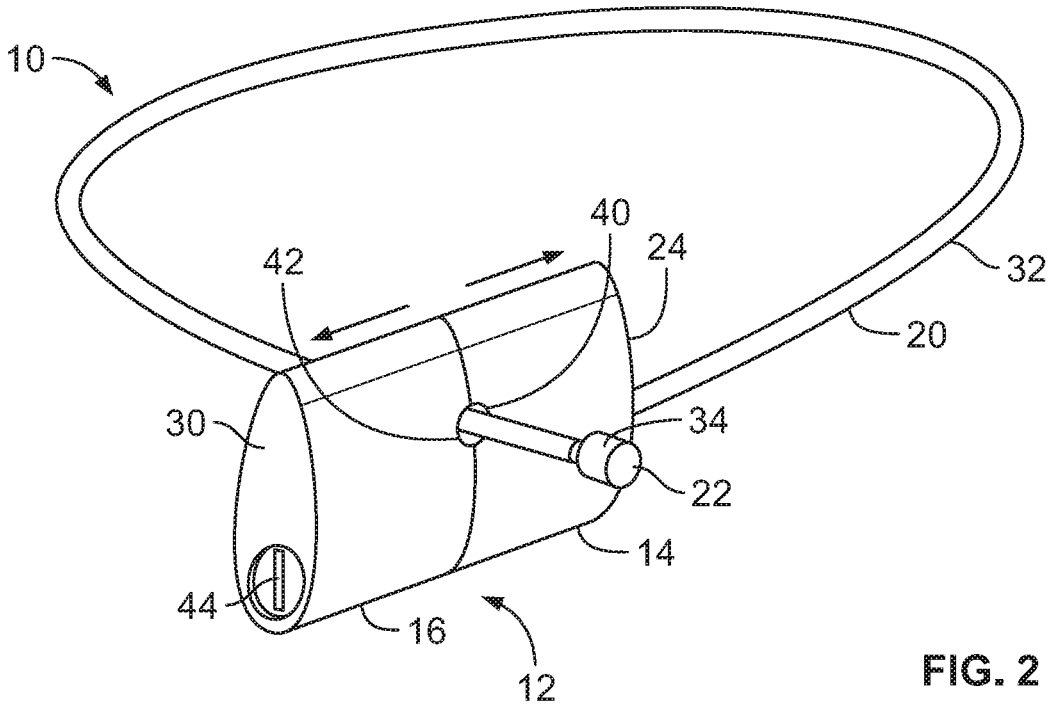
FIG. 2 is a perspective view of an embodiment of the invention in a locked state.
Figure 3:
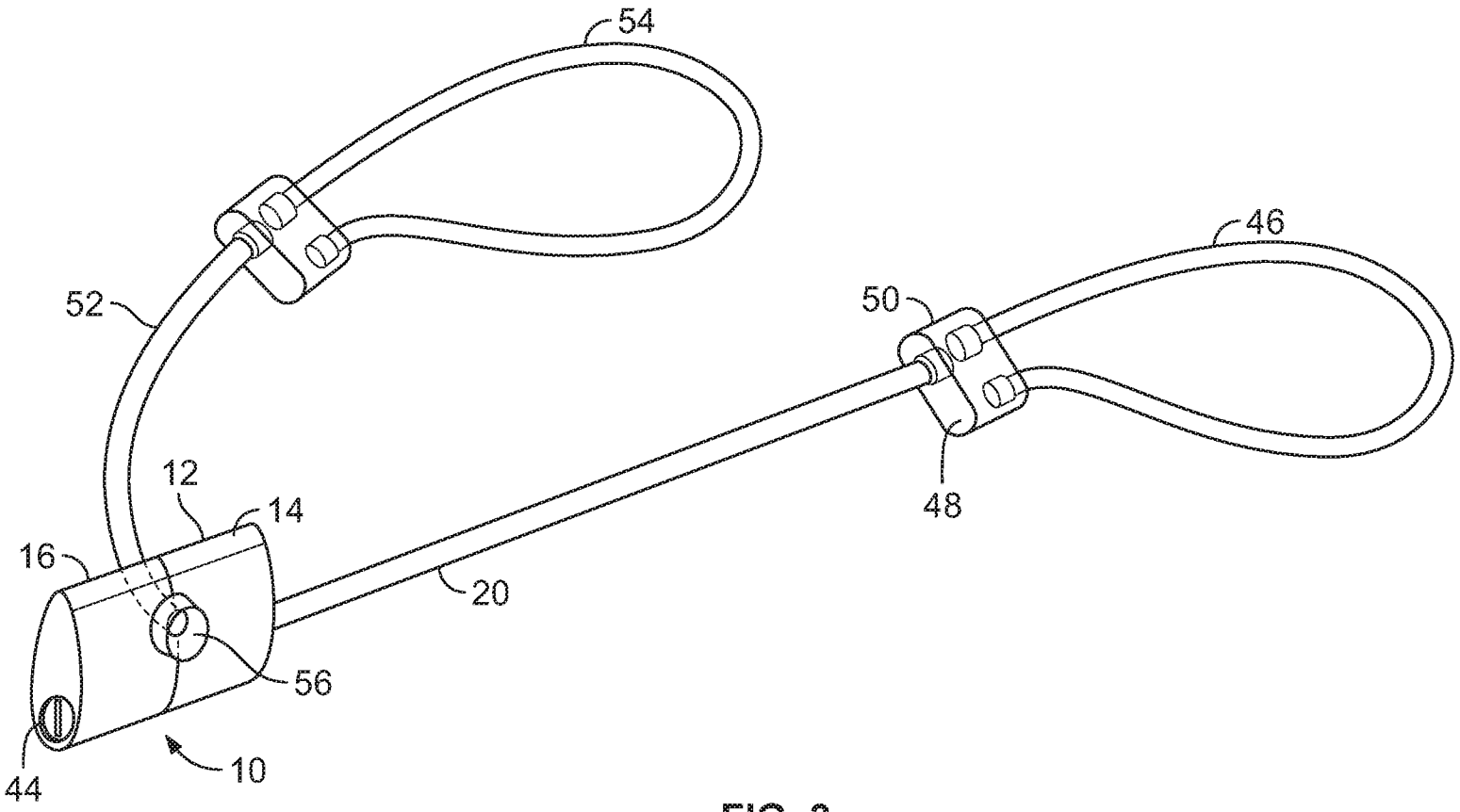
FIG. 3 is a perspective view of an embodiment of the invention utilizing multiple cables.
Figure 4:
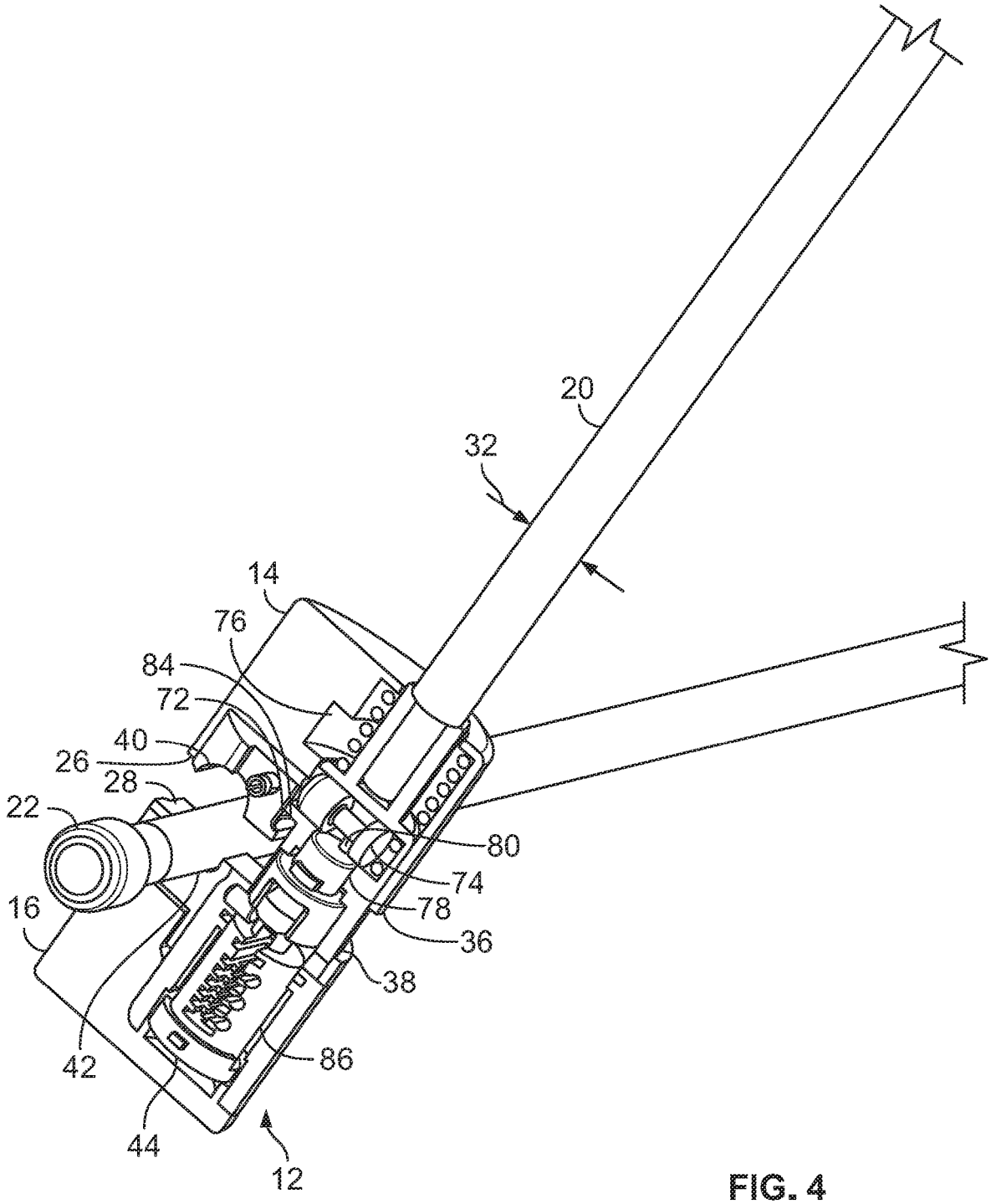
FIG. 4 is a cutaway perspective view of an embodiment of the invention in an unlocked state.
Figure 5:
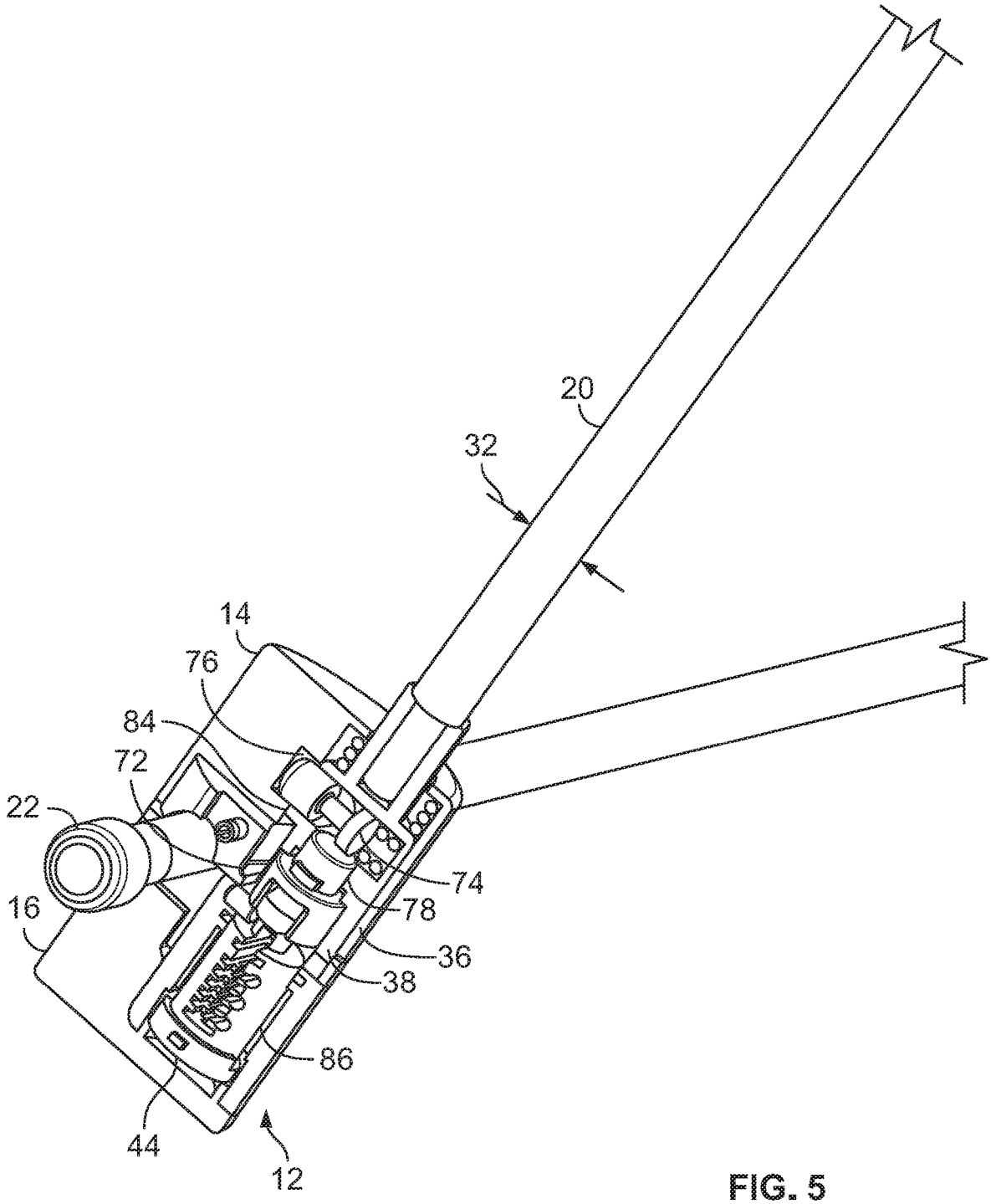
FIG. 5 is a cutaway perspective view of an embodiment of the invention in a locked state.

FIGS. 1, 2 and 3 show a first embodiment of the invention commonly referred to as a cable lock 10. The cable lock 10 comprises a lock body 12 having a base portion 14 and a moveable portion 16. Attached to a first side 24 of the base portion 14 and protruding outwardly therefrom is an elongate cable 20 having a first diameter 32. At the opposite distal end of the cable is a stop or fist 22 having a second diameter 34 that is larger than the cable first diameter. As shown in FIGS. 1, 4 and 5, an extension 36 protrudes from the second face 26 of the base portion 14. The extension 36 is inserted into a receiver 38 in the moveable portion 16 so that the moveable portion will slide or move translationally with respect to the base portion 14 as shown in FIGS. 1-5. In other embodiments, the extension 36 may be part of the moveable portion 16 and the receiver 38 part of the base portion 14. The invention contemplates any means for allowing the two portions to slide translationally, including having the lock body portions being hollow cylinders that slide translationally, one in the other.

A first groove or slot 40 is cut into the face of the second side 26 of the base portion 14. A second groove or slot 42 is also cut into the first side 28 of the moveable portion 16 in this embodiment. In another embodiment, the groove may be cut into only one of the second side 26 of the base or the first side 28 of the moveable portion. The diameter of the groove or grooves 40 and 42 is equal to or slightly larger than the diameter 32 of the cable 20 so that even in the locked state the cable is able to slide in the groove or grooves 40 and 42. However, the diameter of the slots 40 and 42 are smaller than the diameter of the stop or fist 22 so that in the locked state it cannot pass through the lock body 12.

A keyway 44 configured for insertion of a key is located in the moveable portion 16 with the end of the keyway substantially flush with or slightly indented from the second side 30. As can be appreciated, an object can be restrained by looping the cable 20 around the object or through an eyelet, inserting the cable 20 into the grooves 40 and 42, sliding the moveable body 16 toward the base portion 14 and locking the moveable portion 16 into position with the first face 28 of the moveable portion 16 in close proximity to the second face 26 of the base portion 14 so that the stop 22 cannot pass through the grooves 40 and 42.

Figure 6:
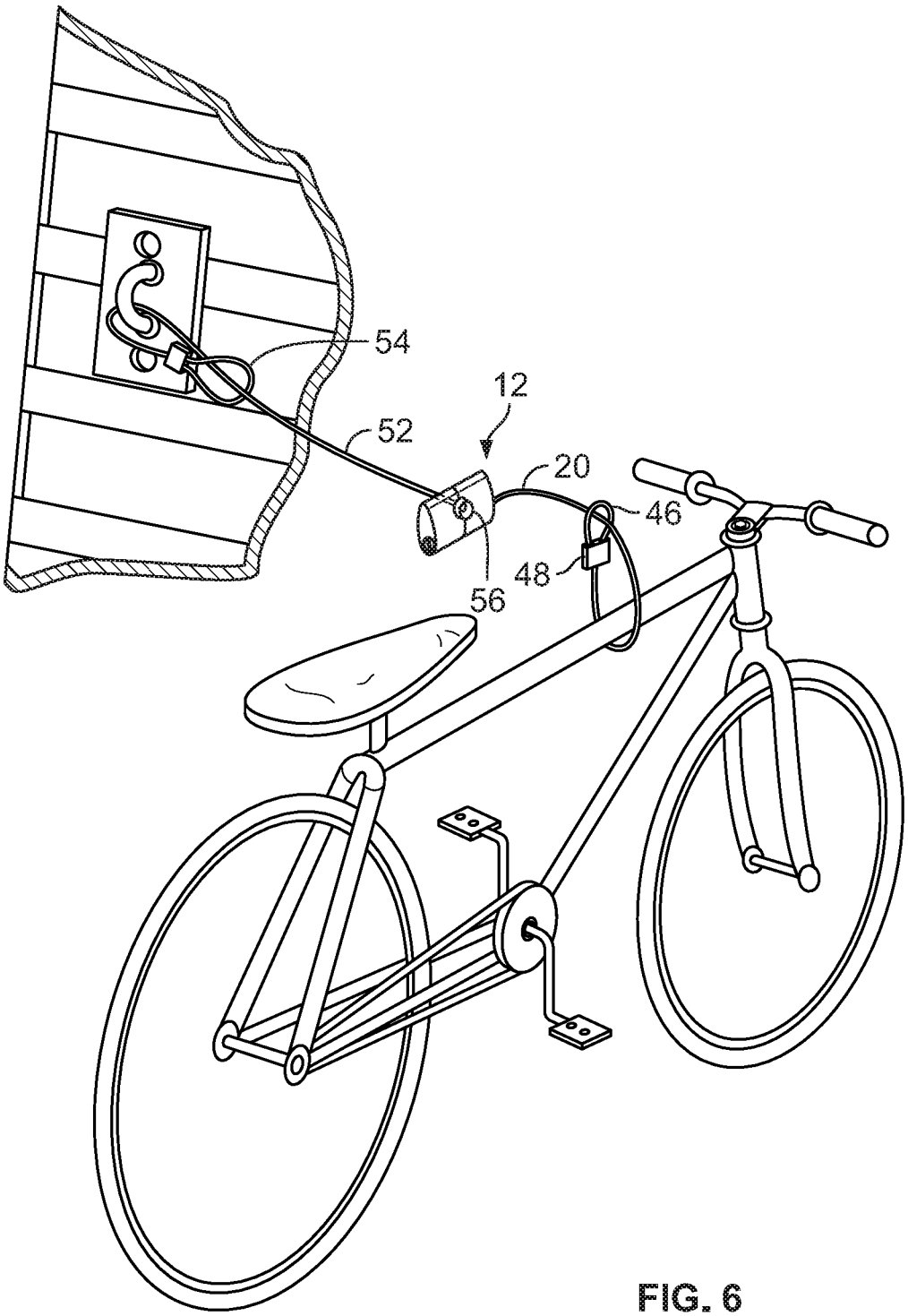
FIG. 6 is a perspective view of one embodiment of the invention securing an object to a substrate.
Figure 7:
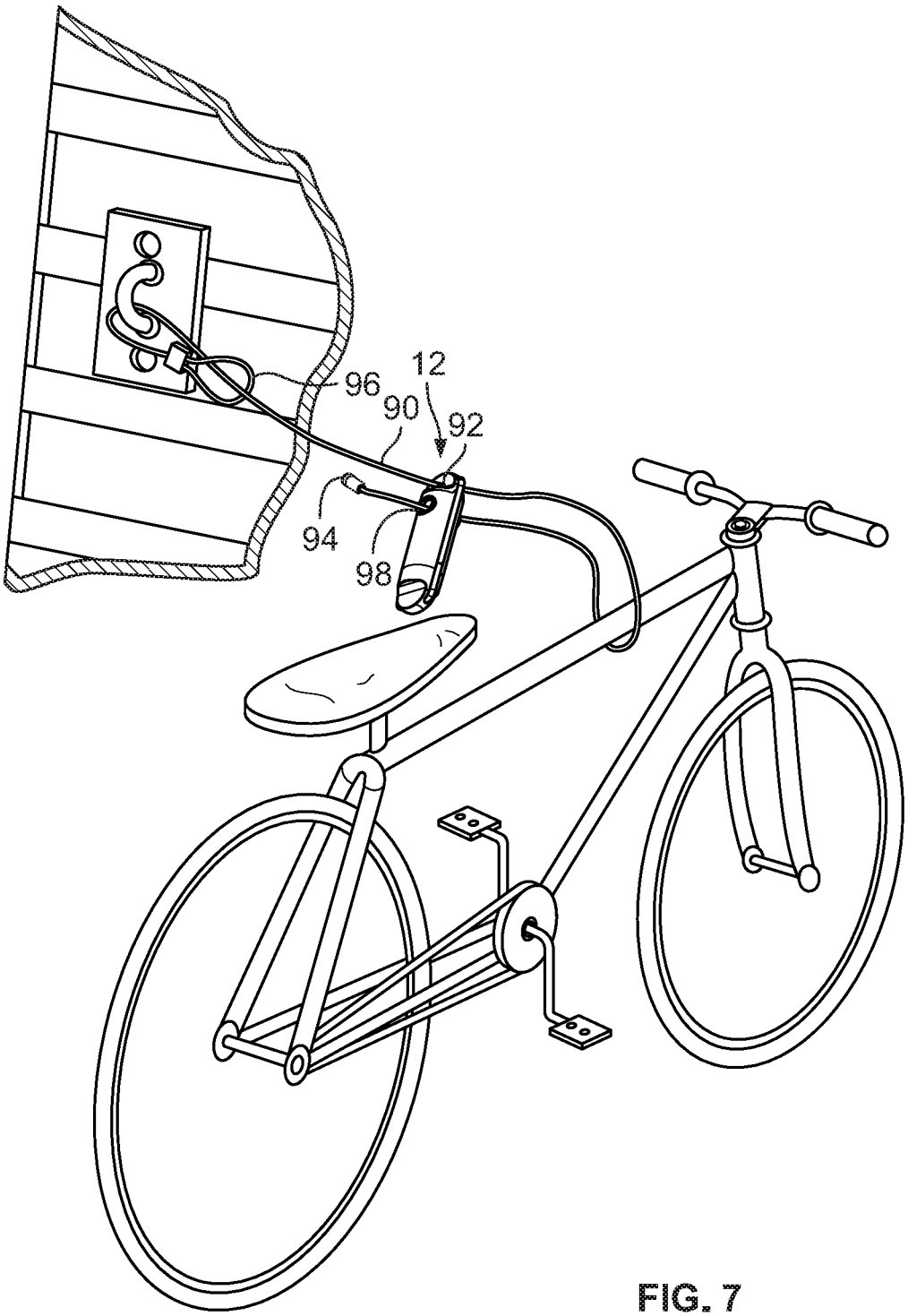
FIG. 7 is a perspective view of another embodiment of the invention securing an object to a substrate.

FIGS. 3, 6 and 7 depict various embodiments and uses of the invention. In FIGS. 3 and 6, the proximal end of the first cable 20 is attached to the base portion 14 of the lock body, and the distal end of the first cable 20 has a loop 46 created by a splice or swage 48 near the end of the cable. In FIG. 3, the swage 48 is a stylized lock body 55 into which cable end stops can be inserted and released. In these embodiments, a second cable 52 also with a loop 54 at the distal end is used to securely attach two objects together. The proximal end of the second cable 52 has a stop 56 with a large diameter similar to the second diameter 34 of stop 22. As shown in FIG. 6, the second cable can be strung around an object or through an eyelet and through its loop 54 like a lasso or slipknot. The stop 56 can be captured in the grooves 40 and 42 the lock body. The cable 20 has a loop 46 at its distal end that has an interior diameter sufficiently large for the lock body 12 to fit through to lasso an object like a bicycle. When the stop 56 is captured by the grooves 40 and 42, the bicycle is secured to an eyelet on a building using the invention.

FIG. 7 shows another embodiment of the invention wherein a single cable 90 passes thought a first aperture 92 in the lock body 12. The cable 90 has a knob 94 at one end and a loop 96 at the other end, with both the diameter of the knob 94 and outer diameter of the loop 96 larger than the diameter of the aperture 92 in the lock body 10. The interior diameter of the loop 96 is sufficient to allow the lock body 12 to pass there through. This embodiment of the lock body also has a second aperture (or pair of apertures if the lock body is hollow) 98. The aperture 98 has an interior locking jaw 99 (see FIGS. 17, 18) that is larger than the diameter of the knob 94 in the unlocked state but smaller than the knob 94 in the locked state, with the locking jaw 99 being able to change from a locked state to an unlocked state by an appropriate key and keyway. By this configuration, the knob can pass through the aperture in the unlocked state, but not pass back through in the locked state. FIG. 7 shows how a bicycle may be secured to an eyelet on a building using a single cable in this embodiment.

Figure 8:
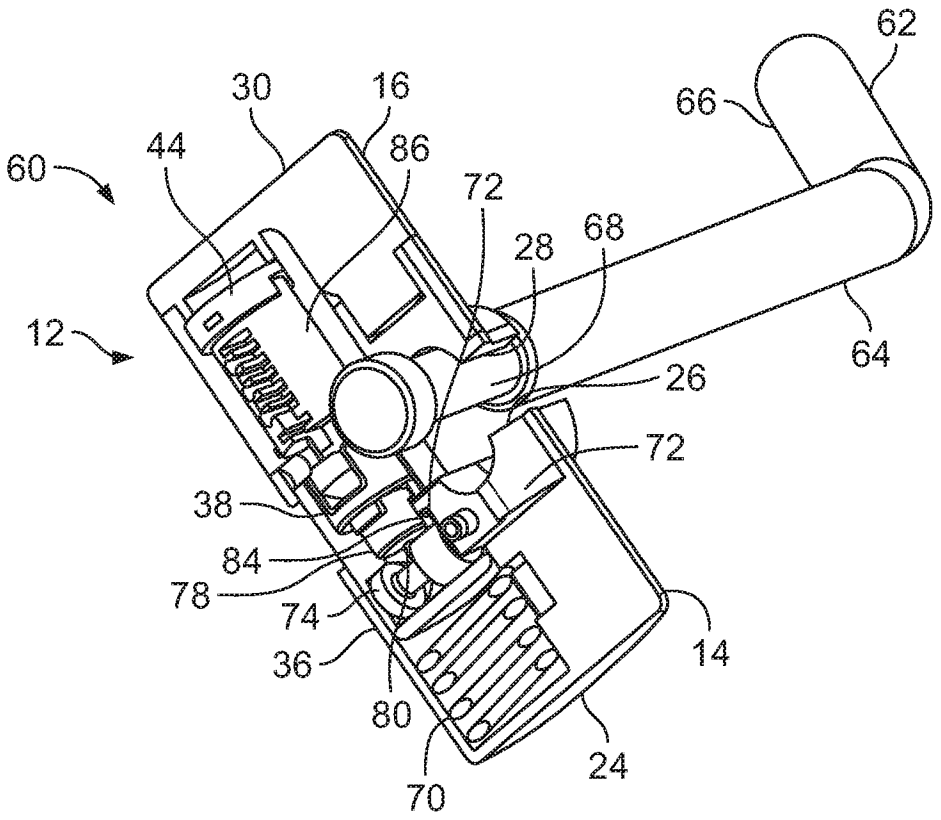
FIG. 8 is a cut away perspective view of another embodiment of the invention in an unlocked state.
Figure 9:
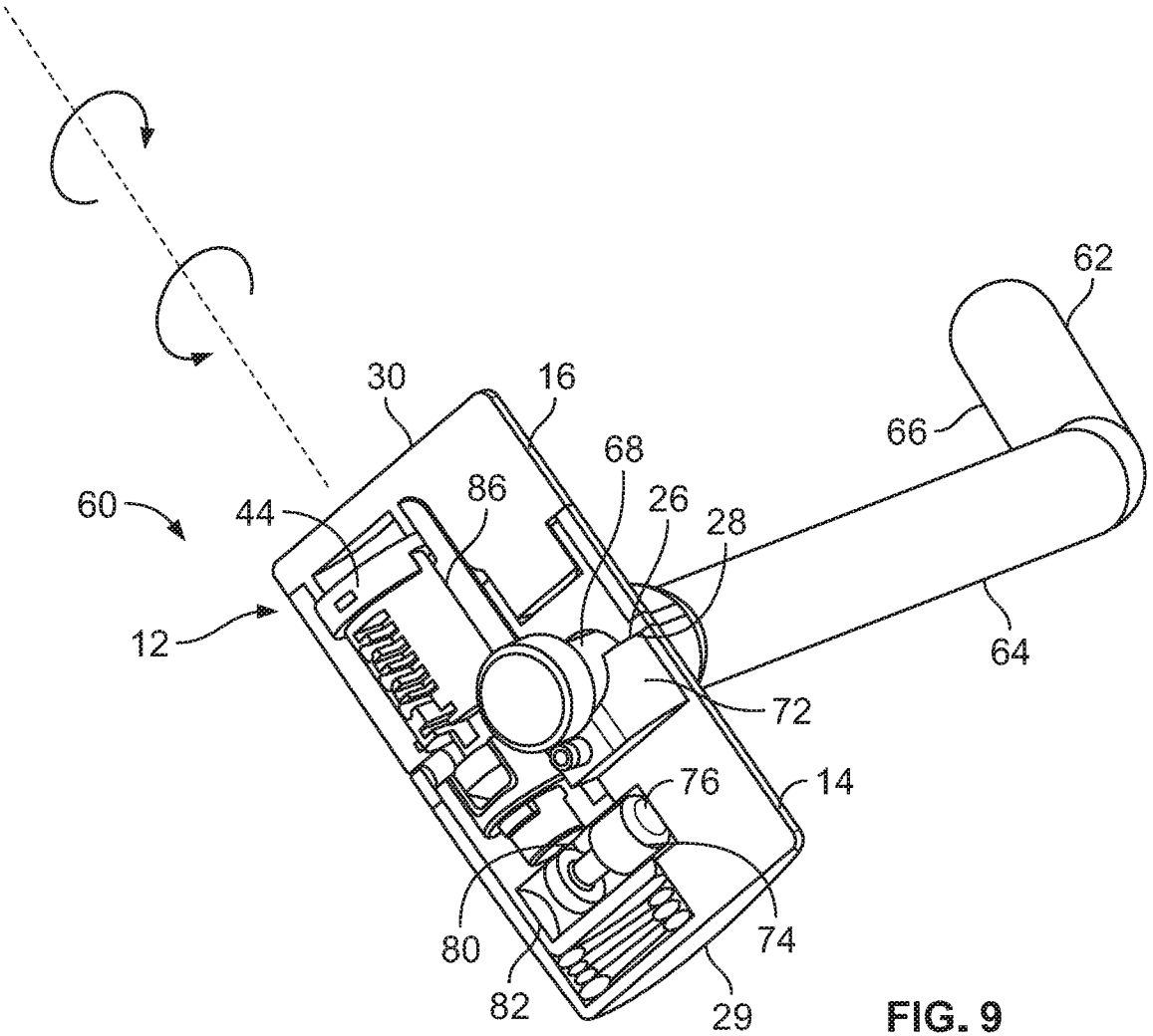
FIG. 9 is a cut away perspective view of another embodiment of the invention in a locked state.

FIGS. 8 and 9 depict an embodiment of the inventive lock body 12 used in conjunction with a trailer hitch pin 62 to create a hitch pin lock 60. The hitch pin 62 has a cylindrical portion 64 with a bent portion 66 or knob (not shown) at one end and a notch 68 of lesser diameter than the cylindrical portion 64 near the other end. In use, the hitch pin 62 is inserted into complementary aligned apertures in a trailer ball holder and a receiver to retain the ball holder in the receiver. The hitch pin lock 60 utilizes essentially the same lock body 12 as the cable lock 10, except there is no cable extending from the first side 24 of the base portion 14. Instead, the moveable portion 16 moves translationally toward and away from the base portion to capture the notch 68 in the grooves 40 and 42.

FIGS. 4, 5, 8 and 9 are cutaway perspective views of one embodiment of the lock body 12, with FIGS. 4 and 5 utilizing the lock body with an elongate cable to wrap and secure objects, while FIGS. 8 and 9 utilize the lock body with slight modifications as a hitch pin lock 60. FIGS. 4 and 8 show the lock body 12 in the unlocked state, while FIGS. 5 and 9 show it in the locked state. A body spring 70 biases the moveable portion 16 away from the base portion 14. The travel is limited by a jaw lip stop 72 cooperating with a lip 84. (See FIGS. 4 and 8). In this embodiment, the extension 36 is part of the base portion and the receiver 38 is part of the moveable portion, but other embodiments could have those reversed. In addition, the ability of the two portions to slide translationally may be achieved by other means than an extension and receiver, such as concentric hollow cylinders.

The moveable portion 16 can slide only when the bolt 74 is moved out of the bolt pocket 76 by rotation of the plug 78 and its cam 80 (see FIG. 7) against the bias of the bolt spring 82. Once the bolt 74 is retracted from the bolt pocket 76 by rotation of the plug 78 by an appropriate key, the body spring 70 biases the moveable portion 16 away from the base portion. To change the lock body 12 from the unlocked state to the locked state, the bias of the spring can be overcome by squeezing the two portions 14 and 16 together until the bolt 74 aligns with the bolt pocket 76 and the bolt spring urges the bolt 74 into the bolt pocket and the face of the second side 26 of the base portion 14 is held in close proximity to the face of the first side 28 of the moveable portion 16.

The plug 78 and associated cam 80 can only rotate in the barrel 86 to allow for movement of the body portions from the locked state to the unlocked state when a proper key is inserted in the keyway 44 and the tumblers are properly retracted from splines in the barrel 86. An exemplary plug 78 and barrel are shown and described in co-pending U.S. patent application Ser. No. 16/439,033 (Publication 2019/0383058).

Figure 10:
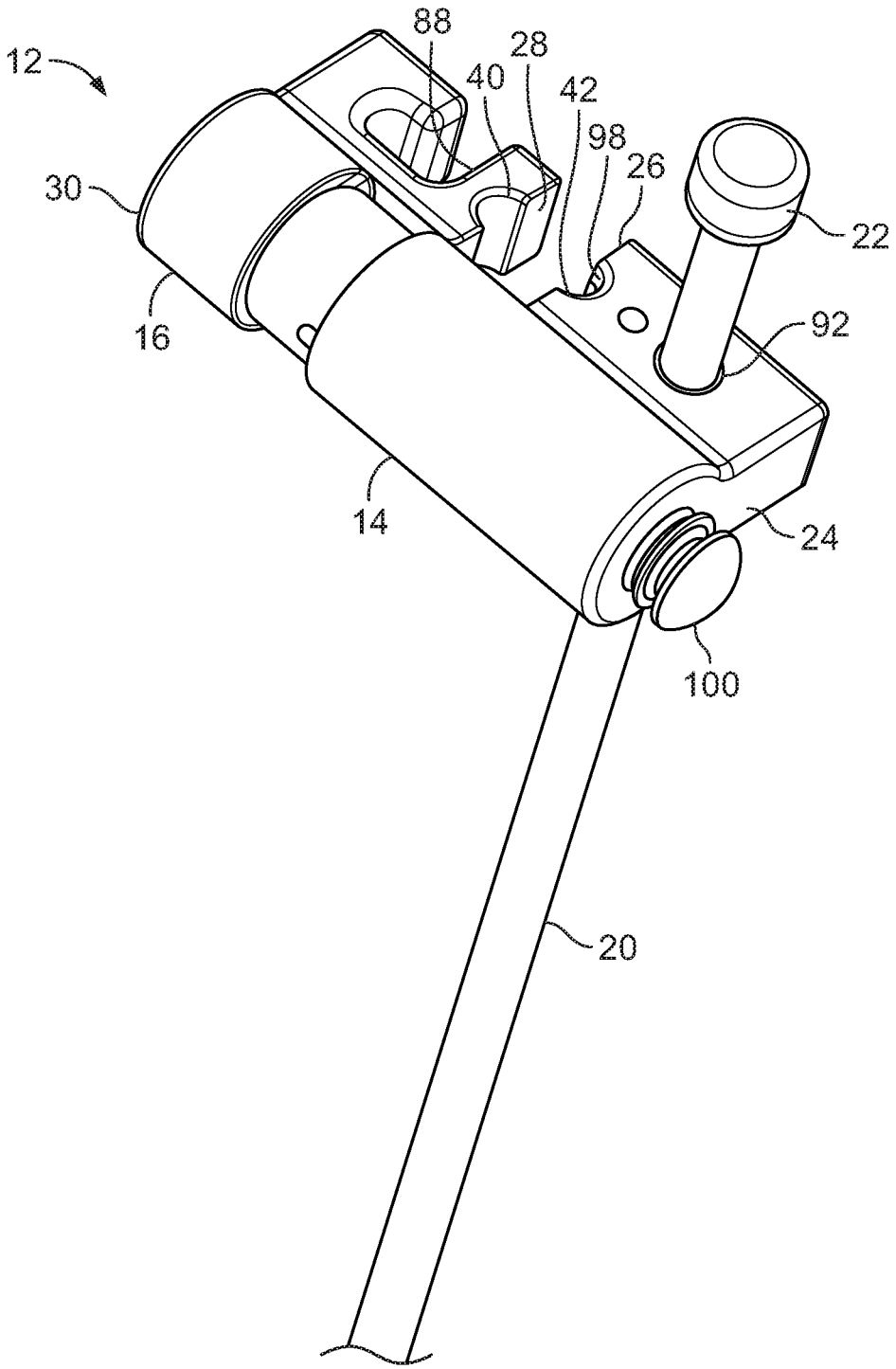
FIG. 10 is a perspective view of another embodiment of the invention in an unlocked state.
Figure 11:
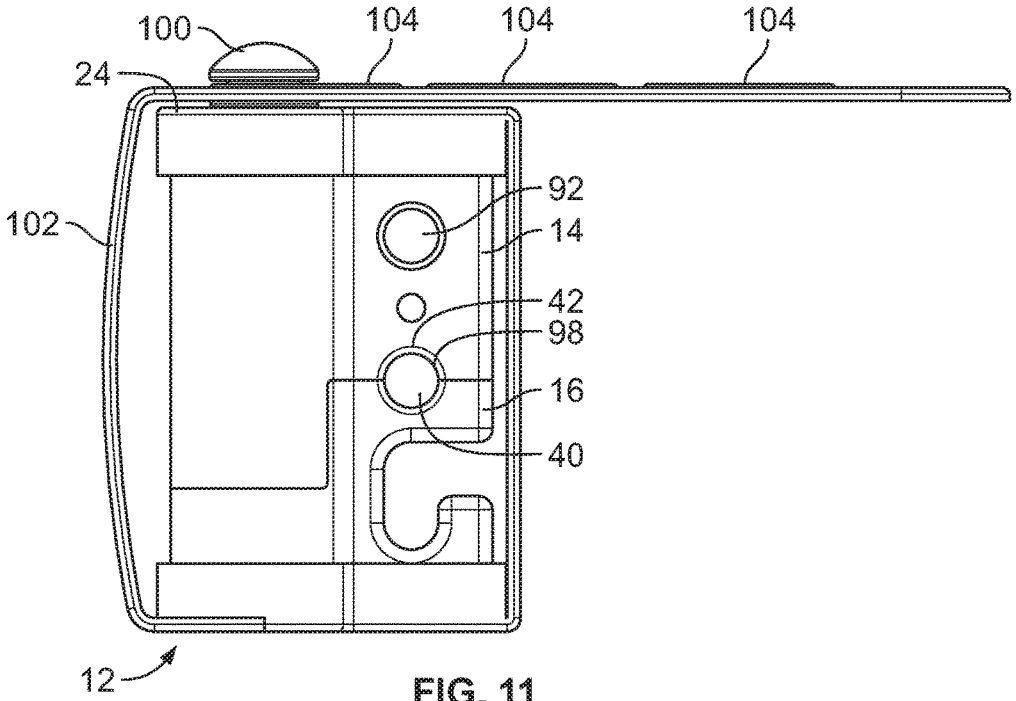
FIG. 11 is a side view of an embodiment of the invention in a locked state.
Figure 12:
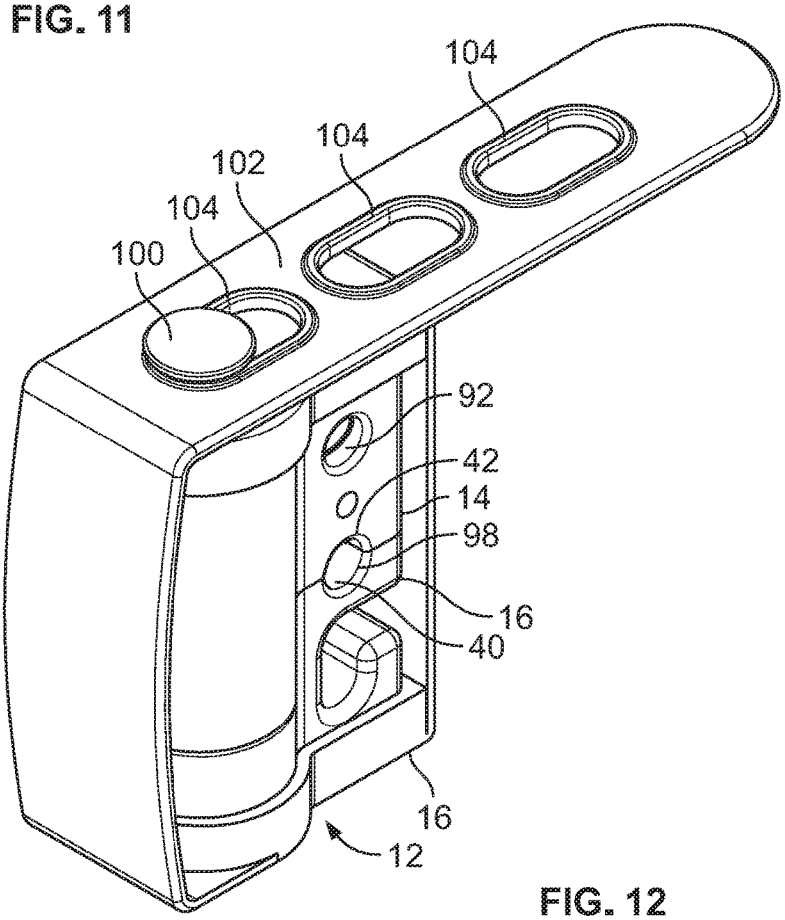
FIG. 12 is a perspective view of an embodiment of the invention in a locked state.
Figure 13:
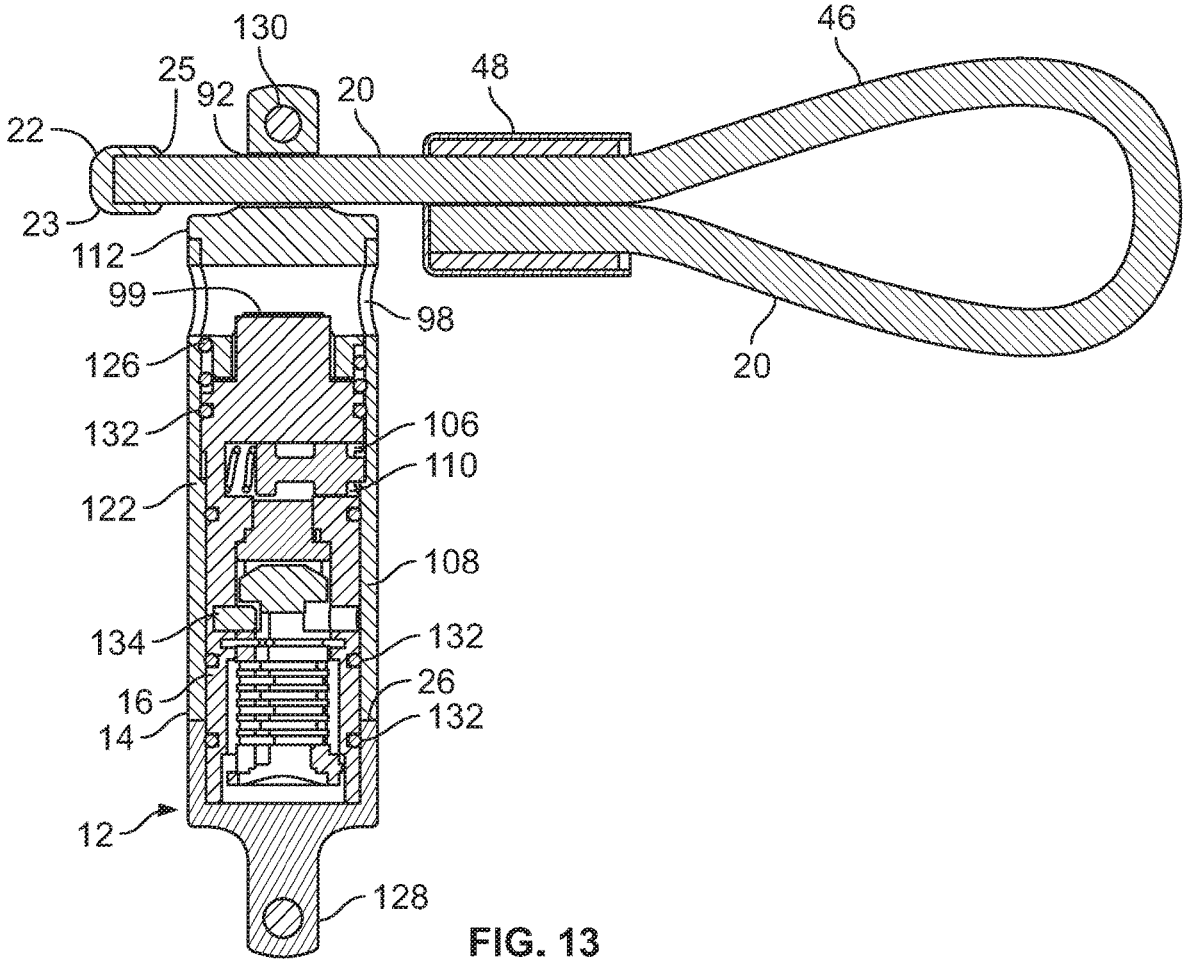
FIG. 13 is a cutaway view of an embodiment of the invention in a locked state.
Figure 14:
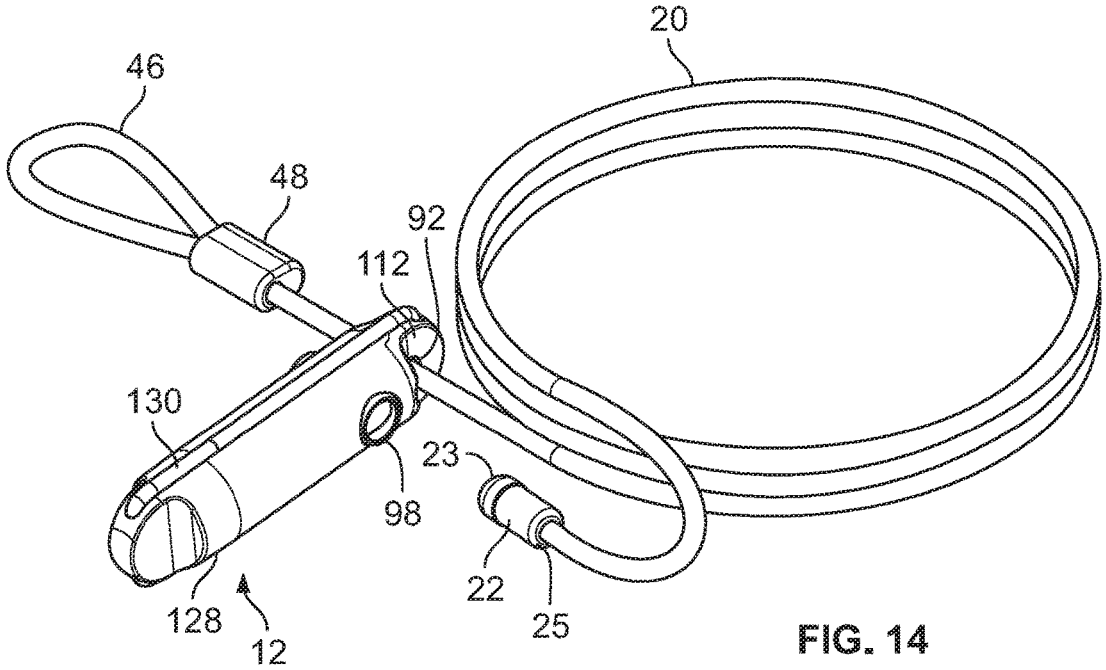
FIG. 14 is a perspective view of an embodiment of the invention with coiled cable.
Figure 15:
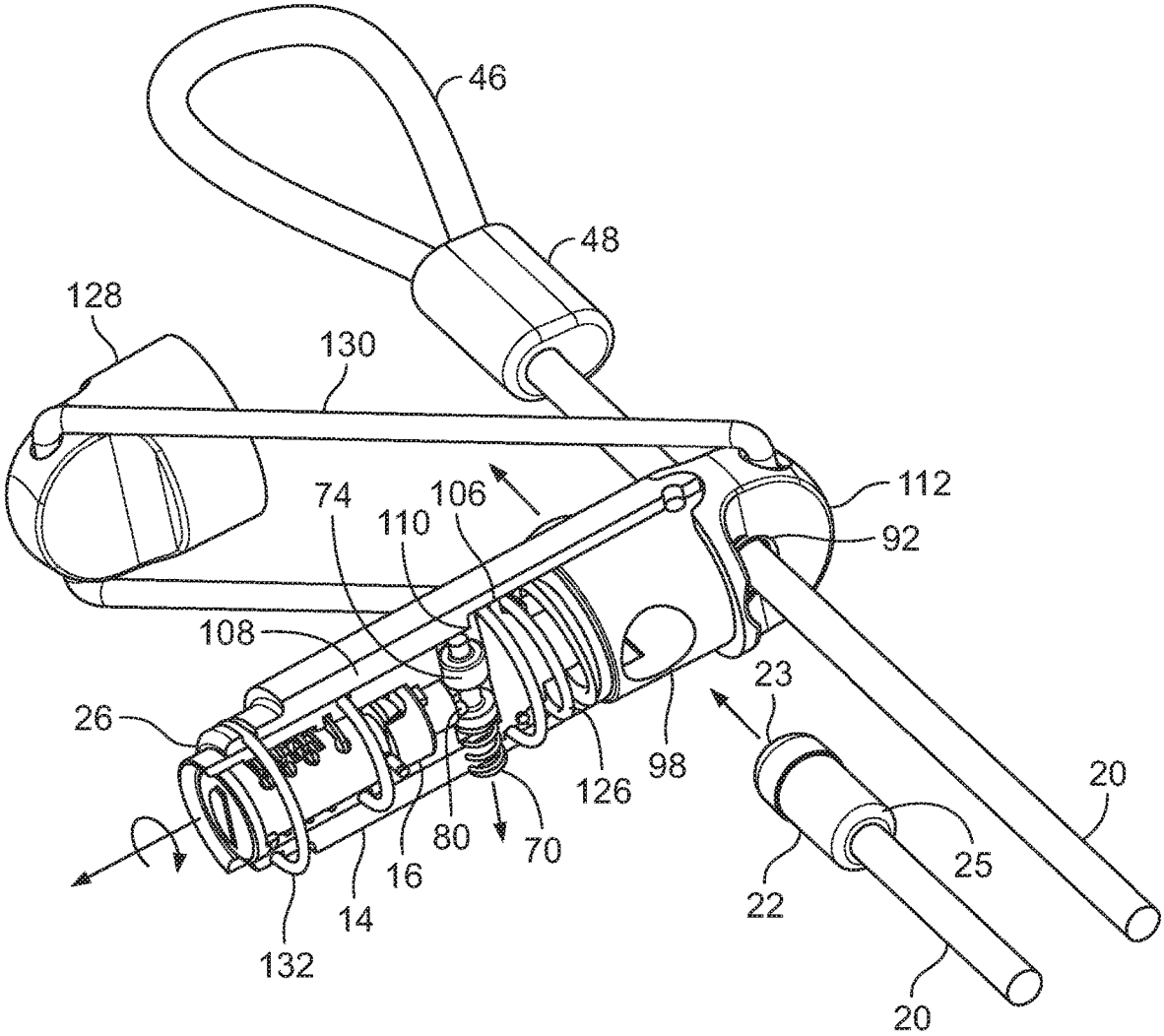
FIG. 15 is a cutaway perspective view of an embodiment of the invention in an unlocked state.
Figure 16:
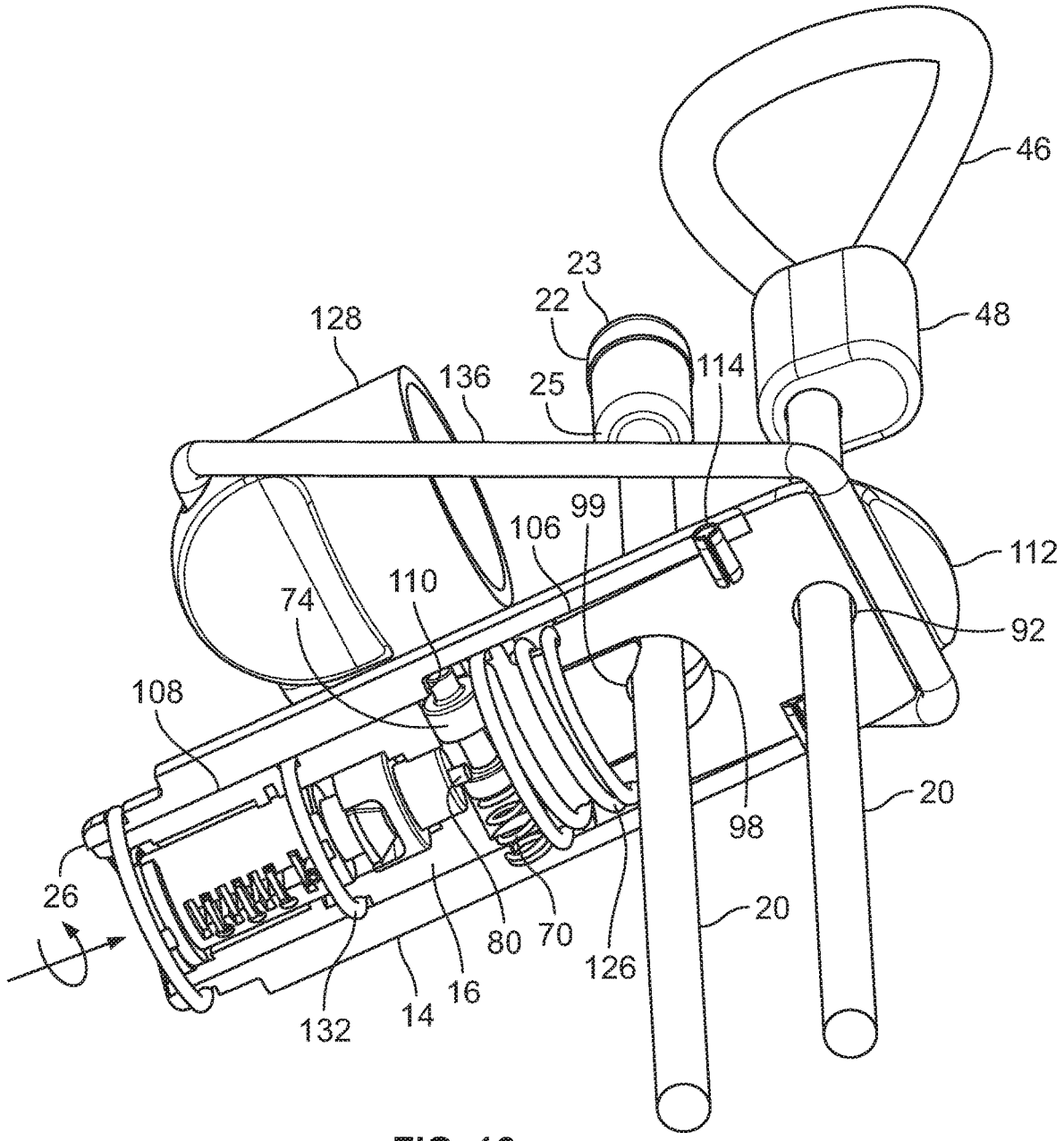
FIG. 16 is a cutaway perspective view of an embodiment of the invention in a locked state.

FIGS. 10, 11 and 12 depict another embodiment of the invention. The lock body 12 has a base portion 14 and a moveable portion 16 as in the earlier embodiments. However, the cable 20 is not fixed to either the base portion or the moveable portion similar to the embodiment shown in FIG. 7. The cable may have fists or stops 22 at either end, or may have a loop 46 at one end or both ends. The cable passes through a first aperture 92, but the fists 22 or loops 46 are too big to pass through the aperture 92. As seen in FIG. 10, the lock body also has a pair of grooves 40 and 42 that when pushed together form a second aperture 98. When utilizing this embodiment, the cable 20 can be wrapped around an object to be secured, and the cable placed in the grooves 40 and 42 in the unlocked state as shown in FIG. 10. The moveable lock body portion 16 can be closed onto the base portion 14 so the grooves form an aperture 98 around the cable 20 in the locked condition as shown in FIGS. 11 and 12. Since the resulting aperture is also smaller than the fist 22 or loop 46 the cable cannot be retracted from the aperture 90 and the object can be secured. The lock body can be changed from the locked state to the unlocked state by inserting and turning a proper key in the keyway in the second side 30 of the moveable portion 16 not shown. The moveable portion is biased into the unlocked state and must be pushed into the locked state. A button 100 is located on the first side 24 of the base portion 14 of the lock body. The button 100 cooperates with button holes 104 in a resilient strap 102 that is wrapped around the moveable portion 16 of the lock body. The button 100 can be placed in a selected button hole 104 to allow the moveable portion 16 to slide in or out of the base portion 14 while still allowing the strap to cover the keyway and also collect and store the elongate cable 20.

FIGS. 13-18 show other embodiments of the invention. In these embodiments, when a cable 20 is shown, it is not fixedly attached to the lock body 12, but is captured in a first transverse aperture 92 in the lock body. Similar to the embodiment of FIGS. 10-12, the diameter of the first aperture 92 is slightly larger than the diameter of the cable 20 so the cable can slide in the aperture, but smaller than a fist or stop 22 at an end of the cable or a loop 46 or swage 48 at an end of the cable. The lock body also comprises a second transverse aperture 98 having a diameter slightly larger than the diameter of the fist 22 so that the fist 22 can slide through the aperture 98 when the lock body 12 is in the unlocked state. The fist may also have a tapered or rounded distal end 23 and a flat proximal end 25 attached to the cable.

The base portion 14 of the lock body 12 in these embodiments is generally a hollow cylinder. The cylindrical base portion 14 has a first portion 106 with an interior diameter and a second portion also with an interior diameter separated by a shoulder 110. The interior diameter of the first portion 106 is larger than the second portion 108. In the embodiments where the base portion 14 is a hollow cylinder, the aperture 98 may actually be a pair of aligned apertures in opposing walls of the first portion 106 of the base 14 with an interior locking jaw 99 between the apertures. In some embodiments, the base portion may also include a cap or plug 112 enclosing one end of the hollow cylinder. The cap 112 has a first end 113 that is proximate the apertures 98 and cooperates with a first end 124 of the barrel to form a locking jaw 99. The cap 112 may be permanently fixed to the cylindrical portion of the base by pins or dowels 114 extending through apertures in the first portion 106 of the base and into blind bores in the cap 112 making it difficult to remove the cap 112 from the first portion 106 of the base. Other means of enclosing the first portion 106 of the cylindrical base portion 14 are also contemplated.

The moveable portion 16 of the lock body resides substantially inside the hollow cylindrical base portion 14. The moveable portion 16 comprises a barrel 116 having longitudinal splines 117 configured to accept tumblers 118 extending outwardly from a plug 120. When a proper key, not shown, is inserted into a keyway in the plug 120, the tumblers 118 are retracted from the splines 117 and the plug 120 is allowed to rotate in the barrel 116. The set of tumblers 118 may also include a plug retaining tumbler 119, configured to allow for removal of the plug 120 with a proper key when the plug is in the unlocked state orientation. Alternatively, a plug pin 134 (See FIG. 13) may be used to retain the plug.

A cam 80 is attached to one end of the plug 120. When the plug is rotated with a proper key, the cam moves normal to the axis of the cylindrical base portion 14. The cam 80 is configured to move a bolt 74 against the bias of a spring 122 into and out of engagement with the shoulder 110 of the interior cylindrical wall of the base portion 14. A compression spring 126 biases the moveable portion 16, including the barrel 116 and the plug 120 away from the cap 112 end of the base portion 14.

Figure 17:
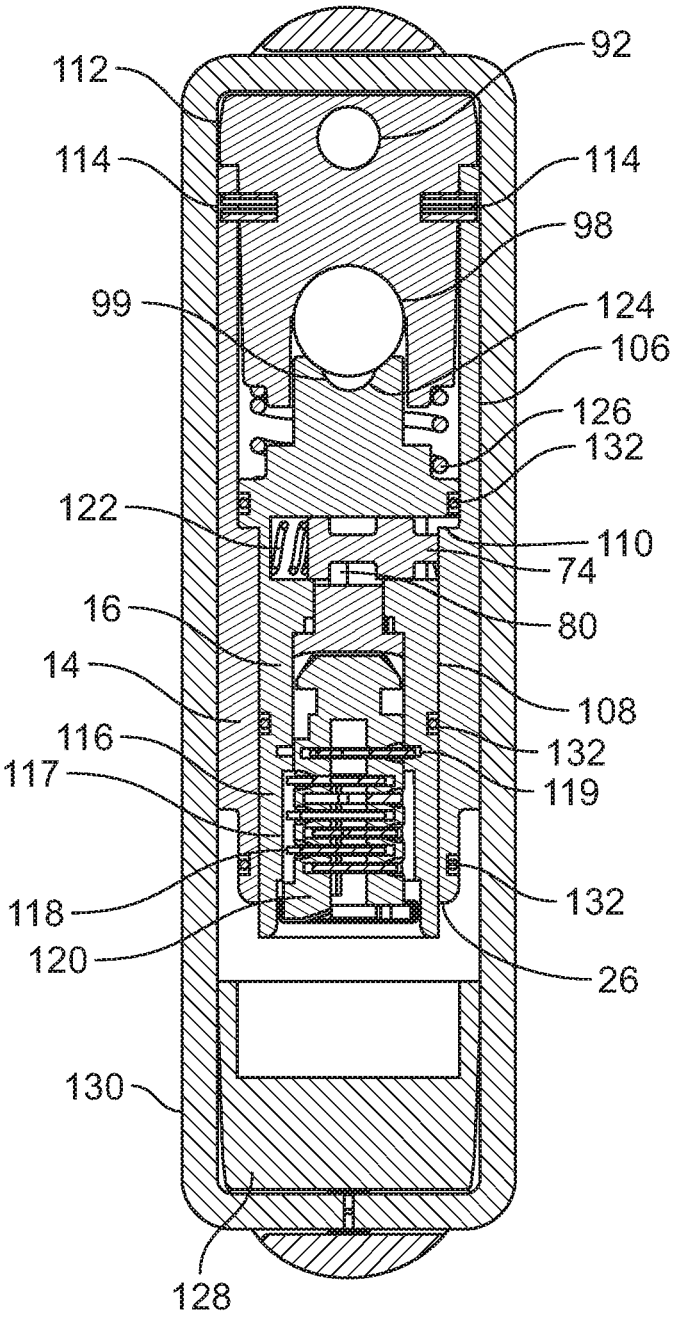
FIG. 17 is a cutaway view of an embodiment of the invention in an unlocked state.
Figure 18:
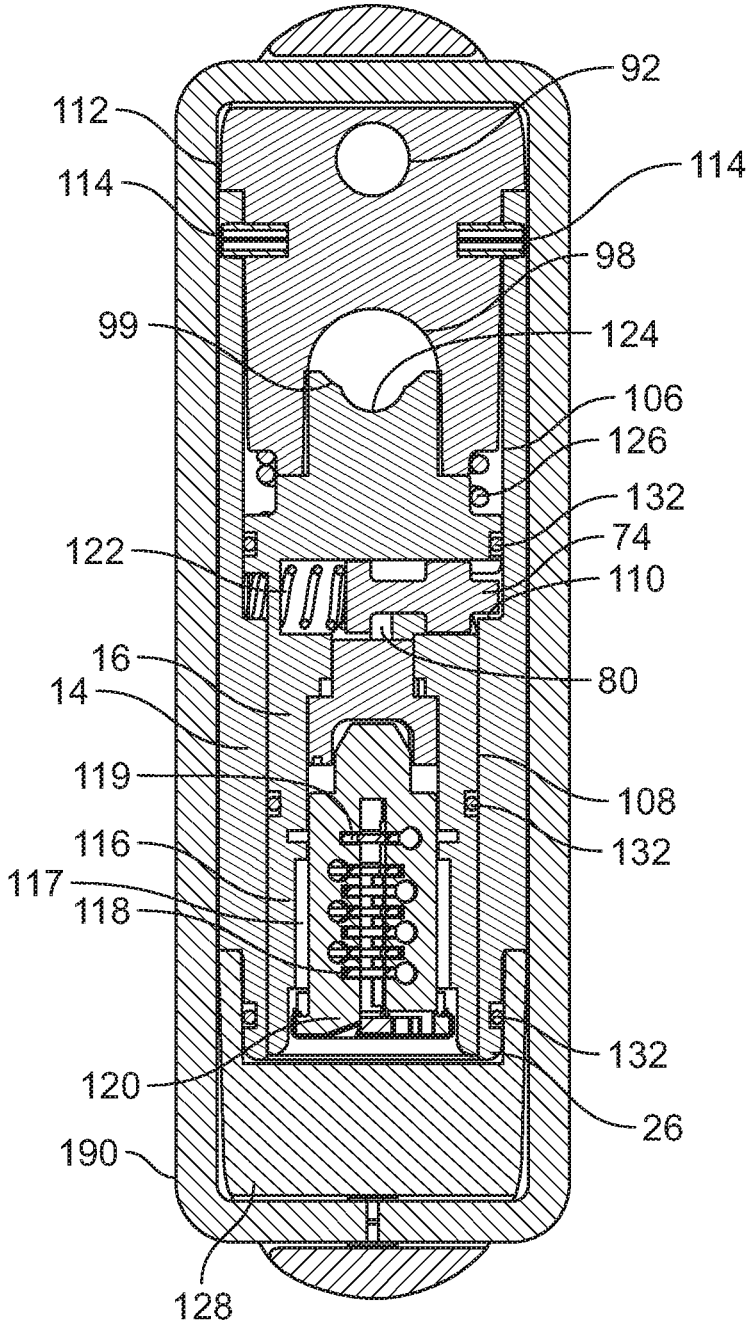
FIG. 18 is a cutaway view of an embodiment of the invention in a locked state.

As shown in FIG. 17, in an open or unlocked state, the cam 80 moves the bolt 74 against the bias of the spring 122 so the bolt is not in contact with the shoulder 110. A first face 124 of the barrel 116 is biased away from an interior surface of the cap so that the locking jaw 99 is retracted and inside of the aperture 98 is large enough to accommodate the diameter of the fist 22 and it can be pushed through the aperture 98. To secure an object to a substrate with a properly oriented cable 20, the moveable portion 16 can be pushed into the base portion 14. The bolt slides along the interior wall of the second portion 108 of the base portion until the bolt is clear of the shoulder 110. As shown in FIG. 18 the cable 20 is then captured by the locking jaw 99 in the smaller diameter portion of aperture 98 and the flat side 25 of the fist or stop 22 is unable to move the first end 124 of the barrel away from the cap 112. It can be appreciated that the rounded end 23 of the fist 22 can be inserted into the aperture 98 in the locked condition, as the taper of the rounded end 23 will push against the bias of the compression spring 126 to move the first end 124 of the barrel away from the cap 112. Once the fist has passed though the aperture 98, the compression spring 126 will snap the moveable portion back into the locked state as shown in FIG. 18.

The lock body 12 may also include a hat 128 attached to a resilient rope or bungee cord 130 to selectively cover and uncover a second side or end 26 of the base and keyway 44 to enhance the weatherability of the lock 10. O-rings 132 are also included between selected moving parts for this purpose.

Although the above described lock has been described, modifications to the structure and associated uses are contemplated by this disclosure. In some embodiments, end to the cable other than loops with swages, stops, or fists can be used for restraining objects. In addition, although a groove, slot, or pair of grooves or slots is shown in various embodiments, other means for capturing a cable or notch in a pin are contemplated and should be included.

Various embodiments disclosed herein are to be taken in the illustrative and explanatory sense, and should in no way be construed as limiting of the present disclosure. While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

I claim:

1. A system for securing an object to a substrate having an eyelet comprising:

an elongate cable having an outer diameter and with a fixed loop having an interior diameter with the loop created by a splice or swage having an outer diameter at a first end of the cable and a fist also having an outer diameter at a second end of the cable with the fist outer diameter larger than the cable outer diameter, but smaller than the splice or swage outer diameter, a hollow cylindrical lock body having an exterior diameter and a first portion with a first interior diameter and a second portion with a second interior diameter with the first interior diameter larger than the second interior diameter and a shoulder separating the two interior diameters, the lock body first portion also having a pair of opposed transverse apertures or notches having a first diameter larger than the fist outer diameter, but smaller than the splice or swage outer diameter;

a fixed cap having an exterior diameter and a first end enclosing the end of the first portion of the lock body and a second end proximate the lock body apertures or notches, the cap also having an aperture with the elongate cable slidingly extending through the aperture, with the cap aperture having an axis normal to the axis of the lock body and the cap aperture having a smaller diameter than the lock body apertures, the swage or splice outer diameter and the fist outer diameter, but larger than the cable diameter;

a barrel configured to have limited longitudinal movement in the lock body, the barrel having interior splines configured to accept tumblers, the barrel also having a first face adjacent the pair of lock body apertures or notches and opposite the cap second end;

a barrel spring adapted to bias the barrel away from the cap;

a plug having a keyway and radially extending tumblers, the plug configured to move longitudinally with the barrel and rotate inside the barrel when the tumblers are retracted from the splines by an appropriate key inserted into the keyway, the plug also having a cam that provides motion normal to the longitudinal axis of the lock body when the plug is rotated; and a bolt in the interior of the lock body biased by a bolt spring to move radially outwardly to contact the shoulder in a first locked state wherein the cap second end and the barrel first face are located at a distance less than the first diameter of the pair of transverse apertures or notches, and configured to be moved by the cam against the bias of the bolt spring to retract the bolt away from the shoulder in an unlocked state, and the barrel spring biases the barrel first face longitudinally away from the cap second end to a distance equal to or larger than the first diameter of the pair of transverse apertures or notches;

and wherein the cable passes through the eyelet in the substrate, the cable, the body and the cap pass through the interior of the cable fixed loop and the cable passes through the object to be secured and the cable and fist pass through the pair of lock body apertures and between the barrel first face and cap second end when the lock is in the unlocked state but the fist will not pass between the barrel first face and cap second end when the lock is in the locked state.

2. The system of claim 1 also having a hat adapted to selectively cover the second end of the lock body.

3. The system of claim 1 wherein the cap is fixed to the lock body by transverse pins extending through apertures in the lock body and into transverse bores in the cap.

4. A system for securing an object to a substrate comprising:

an elongate cable having an outer diameter and with a fixed loop having an interior diameter with the loop created by a splice or swage having an outer diameter at a first end of the cable and a fist also having an outer diameter at a second end of the cable with the fist outer diameter larger than the cable outer diameter, but smaller than the splice or swage outer diameter, a hollow cylindrical lock body having an exterior diameter and a first portion with a first interior diameter and a second portion with a second interior diameter with the first interior diameter larger than the second interior diameter and a shoulder separating the two interior diameters, the lock body first portion also having a pair of opposed transverse apertures or notches having a first diameter larger than the fist outer diameter, but smaller than the splice or swage outer diameter;

a fixed cap having an exterior diameter and a first end enclosing the end of the first portion of the lock body and a second end proximate the lock body apertures or notches, the cap also having an aperture with the elongate cable slidingly extending through the aperture, with the cap aperture having an axis normal to the axis of the lock body and the cap aperture having a smaller diameter than the lock body apertures or notches, the swage or splice outer diameter and the fist outer diameter, but larger than the cable diameter;

a barrel configured to have limited longitudinal movement in the lock body, the barrel having interior splines configured to accept tumblers, the barrel also having a first face adjacent the pair of lock body apertures or notches and opposite the cap second end;

a barrel spring adapted to bias the barrel away from the cap;

a plug having a keyway and radially extending tumblers, the plug configured to move longitudinally with the barrel and rotate inside the barrel when the tumblers are retracted from the splines by an appropriate key inserted into the keyway, the plug also having a cam that provides motion normal to the longitudinal axis of the lock body when the plug is rotated; and a bolt in the interior of the lock body biased by a bolt spring to move radially outwardly in the first portion of the lock body to contact the shoulder in a first locked state wherein the cap second end and the barrel first face are located at a distance less than the first diameter of the pair of transverse apertures or notches, and configured to be moved by the cam against the bias of the bolt spring to retract the bolt away from the shoulder in an unlocked state, and the barrel spring biases the barrel first face longitudinally away from the cap second end to a distance equal to or larger than the first diameter of the pair of transverse apertures or notches and the bolt is moved to the second portion of the lock body;

and wherein the cable, the body and the cap pass through the interior of the cable fixed loop and the cable passes through the object to be secured and the cable and fist pass through the pair of lock body apertures and between the barrel first face and cap second end when the lock is in the unlocked state but the fist will not pass between the barrel first face and cap second end when the lock is in the locked state.

5. The system of claim 4 having a hat adapted to selectively cover the second end of the lock body.

6. The system of claim 4 wherein the cap is fixed to the lock body by transverse pins extending through apertures in the lock body and into transverse bores in the cap.

7. The system of claim 4 wherein the lock body is changed from an unlocked state to a locked state by inserting an appropriate key into the keyway, moving the plug and bolt longitudinally against the bias of the barrel spring so the barrel face and the cap second end are located at a distance less than the diameter of the plug, but equal to or more than the diameter of the cable and the bolt is moved into the first portion of the lock body, the key and plug are rotated and the cam urges the bolt transversely outwardly so it contacts the shoulder.

* * * * *